United States Patent [19]

Hager

[11] 4,256,320

[45] Mar. 17, 1981

[54] PULL HANDLE FOR ROLLER MOUNTED SUITCASES

[76] Inventor: Robert G. Hager, 219 Aderno Way, Pacific Palisades, Calif. 90272

[21] Appl. No.: 40,161

[22] Filed: May 18, 1979

[51] Int. Cl.[3] ..... B62B 1/12

[52] U.S. Cl. ..... 280/37; 190/18 A

[58] Field of Search ..... 280/35, 37, 47.17, 47.37 R, 280/47.37 L; 190/18 R, 18 A; 292/127, 227; 74/538

[56] References Cited

U.S. PATENT DOCUMENTS

| | | | |
|---|---|---|---|
| 1,661,548 | 3/1928 | Stuart et al. | 292/127 |
| 1,700,299 | 1/1929 | Wolters | 292/127 X |
| 2,463,713 | 3/1949 | Partiot | 280/37 |
| 2,472,491 | 6/1949 | Quinton | 280/37 |
| 2,557,365 | 6/1951 | Weber | 74/538 X |
| 3,799,568 | 3/1974 | Hager | 280/37 |

*Primary Examiner*—John J. Love
*Assistant Examiner*—Michael Mar
*Attorney, Agent, or Firm*—Ralph B. Pastoriza

[57] ABSTRACT

A pull handle for a roller mounted suitcase includes an elongated supporting tube secured just beneath the top side of the suitcase telescopically receiving an extension member having a gripping handle on one end. Cooperating indexing arrangements are provided on the supporting tube and extension member for holding the member in a given extended telescoped position relative to the suitcase in which position, the gripping handle is at a sufficient distance from the suitcase for convenient gripping by a user for guiding the suitcase on its rollers along the ground. Manual release arrangements are provided to release the telescoping extended member and permit retraction of the same into its supporting tube when not in use.

4 Claims, 13 Drawing Figures

PULL HANDLE FOR ROLLER MOUNTED SUITCASES

This invention relates generally to mobile luggage and more particularly to a pull handle construction for roller mounted suitcases.

BACKGROUND OF THE INVENTION

In my U.S. Pat. No. 3,799,568 issued Mar. 26, 1974 and reissued as U.S. Pat. No. Re. 29036 on Nov. 16, 1976 there is disclosed a roller mounted suitcase with a telescoping pull handle for facilitating moving the suitcase along the ground and relieving a user from having to carry the full weight of the suitcase. A spring biased ball detent means is included in the telescoping structure to index the extending handle member to selected first or second positions depending upon which is most convenient for the particular user. The particular spring biased ball detent structure described requires certain components in the construction of the telescoping handle in addition to the basic supporting tube and extension member. Further, the spring biased ball and detent arrangement do not really provide for a positive locking of the telescoping extending handle member in a selected position with the result that the handle member might unexpectedly telescope further out or further inwardly under certain types of maneuvers of the suitcase.

My above-mentioned U.S. Patent, together with references cited therein constitute the closest known prior art to my present invention which is directed towards overcoming some of the problems associated with spring biased detent means for indexing movement of the telescoping member as described above.

BRIEF DESCRIPTION OF THE PRESENT INVENTION

With the foregoing in mind, my present invention contemplates the provision of a pull handle for a roller mounted suitcase of the type described in my heretofore referred to United States Patent wherein there is included cooperating indexing means on the supporting tube and the extension member for holding the member in a given extended telescoped position relative to the supporting tube, wherein such securing of the member in a desired given telescoped position is positive so that there is no possibility of inadvertent displacement. In addition, my invention provides in combination with such cooperating indexing means, a manual release means operable by a person gripping the handle of the extension member to release the indexing means and thereby permit the extension member with the handle to be fully retracted into the supporting tube in the suitcase when not in use.

BRIEF DESCRIPTION OF THE DRAWINGS

A further understanding of my invention and various embodiments thereof will be had by now referring to the accompanying drawings in which.

DETAILED DESCRIPTION OF THE INVENTION

Figure 1:
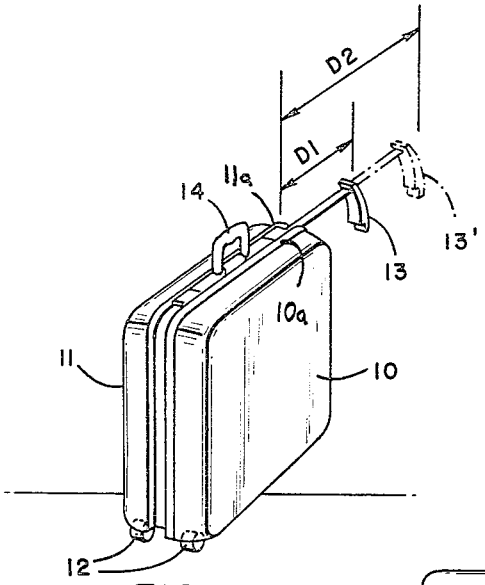
FIG. 1 is a perspective view of a roller mounted suitcase with the pull handle of my invention shown in a first position in solid lines and in a second indexed position by phantom lines.

Referring first to FIG. 1, there is shown a roller mounted suitcase made up of half portions 10 and 11. In the embodiment illustrated, the suitcase is generally rectangular in shape when viewed from the side and includes rollers 12 at one lower corner. A gripping handle 13 is shown on the end of an extension member for gripping by a person in guiding the suitcase on the rollers 12. Handle 13 is arranged to be extended a first given distance D1 from the suitcase or, in the particular embodiment to be described, a second greater distance D2, as indicated at 13'. If it is desired not to use the handle, the same is wholly retracted into the central channels **10*a* and 11*a* framing the adjacent half portions 10 and 11, and the conventional handle 14** is used to carry the suitcase.

Figure 2:
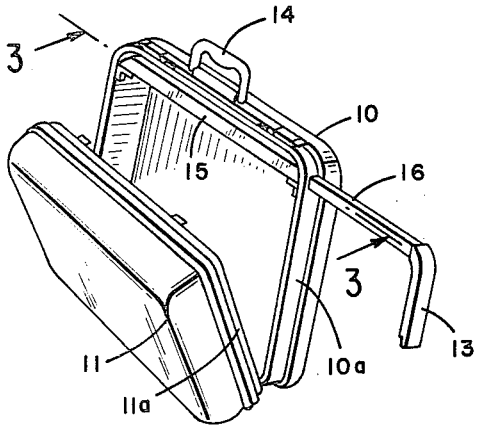
FIG. 2 is another perspective view of the suitcase in FIG. 1 in partially open position to expose interior portions of the telescoping handle arrangement.

FIG. 2 shows the half portions 10 and 11 in partially open position in the manner of a clam shell. The telescoping handle structure includes a basic elongated supporting tube shown at 15 extending along the top of the rectangular shape immediately beneath the channel structure **10*a*. Extension member 16 in turn carries the gripping handle 13 at one end and has its other end telescopically slidable into and out of the one end of the tube 15 at the upper corner of the rectangular shape diagonally opposite the one lower corner supporting the wheels 12**.

As will become clearer as the description proceeds, each of the embodiments to be described include cooperating indexing means on the supporting tube and extension member for holding the extension member with the handle 13 in a given extended telescoped position relative to the supporting tube so that the handle 13 is at a sufficient distance from the suitcase for convenient gripping by a user for guiding the roller mounted suitcase along the ground as described with respect to FIG. 1. Further, each of the embodiments incorporates a manual release means operable by a person gripping the handle 13 to release the indexing means and permit the member to be fully retracted into the supporting tube when not in use.

Figure 3:
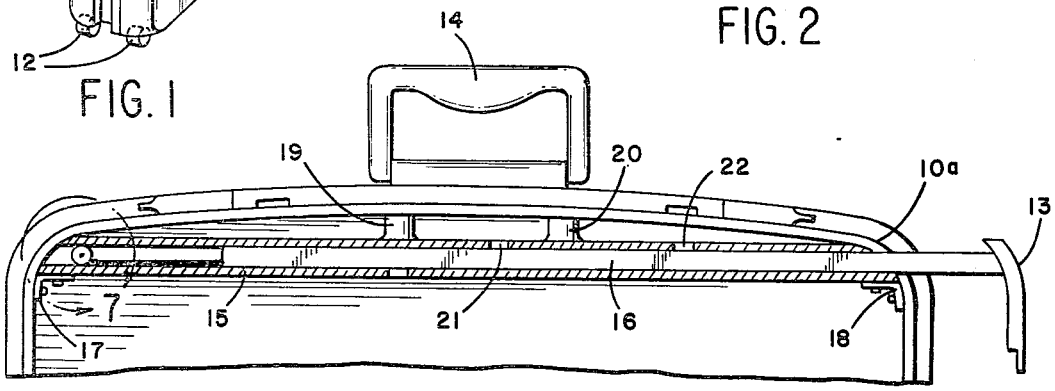
FIG. 3 is a greatly enlarged cross section taken in the direction of the arrows 3—3 of FIG. 2.

FIG. 3 illustrates a first embodiment of the invention wherein it will be noted that the supporting tube 15 is thoroughly anchored immediately beneath the channel frame 10*a* along the top of the suitcase as shown in FIG. 2 as by end brackets 17 and 18. In addition, securing supports 19 and 20 may be included for those types of suitcases where the top portion bows upwardly.

The extension member 16, in turn, is shown in full lines in FIG. 3 in a further telescoped inward position than that depicted in FIG. 2 to more simply illustrate the telescoping manner in which the member can be moved.

In FIG. 3, portions of the cooperating indexing means take the form of cavity structures indicated at 21 and 22 in the top wall of the supporting tube 15.

Figure 4:
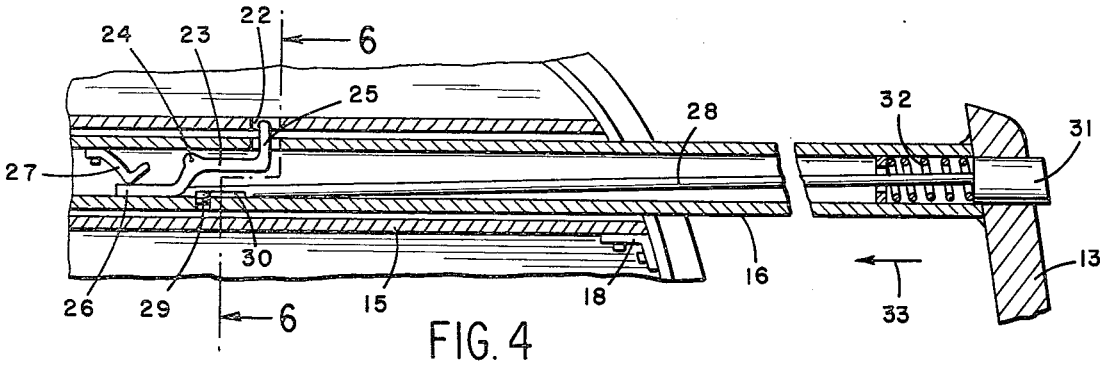
FIG. 4 is a still further enlarged fragmentary cross section of a portion of the structure of FIG. 3.

Referring now to FIG. 4, it will be noted that the extension member 16 has a hollow interior within which there is provided a cooperating portion of the indexing means in the form of a lever 23. Lever 23 is pivoted for rocking movement about a pivot axis 24 to the extension member 16. One end of the lever 23 constitutes a laterally extending pin 25 passing through an aligned opening in the extension member 16 so as to be received within the cavity structure 22 when the extension member 16 is telescoped to the referred to second position depicted by dashed lines in FIG. 1. The pin 25 itself on this one end of the lever is biased upwardly as illustrated in FIG. 4 by a leaf spring 27 incorporated within the hollow extension member 16.

The manual releasing means for the embodiment shown in FIGS. 3 and 4 constitute an elongated rod 28 extending from the handle 13 to the lever 23. The end portion of the rod engaging the lever 23 receives a guide pin 29 within a small slot portion 30 to guide limited movement of the rod 28 to the left and right a sufficient distance to effect a rocking action of the lever 23.

Referring to the right end of the rod 28, it will be noted the same terminates in a push button 31 mounted for left and right movement in the gripping handle 13. A spring 32 biases the button 31 to the right as illustrated in FIG. 4.

Figure 5:
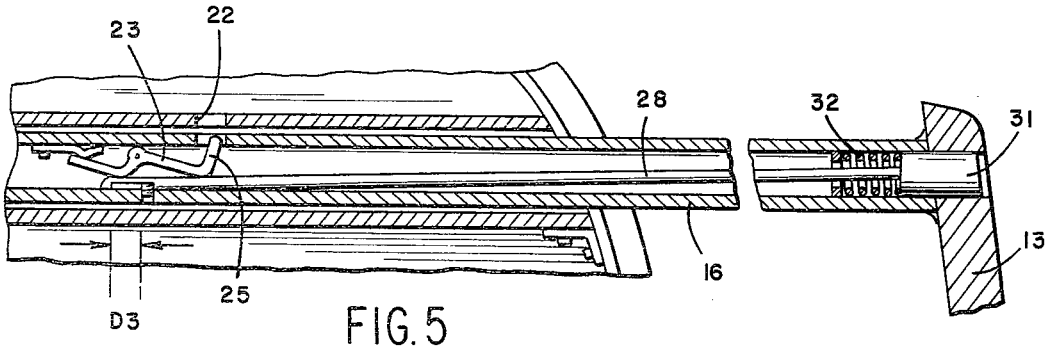
FIG. 5 is a cross section similar to FIG. 4 but illustrating the relative positions of certain components when the indexing structure has been manually released.

When it is desired to release the extension member 16 from the supporting tube 15 so that the same can be telescoped to a different position or completely retracted, it is necessary to remove the lateral pin 25 from the cavity structure 22. This action is accomplished by pressing the button 31 in the gripping handle 13 as illustrated in FIG. 5 to move the rod in such a manner as to cam the lever 23 in a clockwise direction. It is only necessary to move a short distance indicated at D3 in FIG. 5 to effect the necessary rocking action to release the extension member 16 from the supporting tube.

So long as the user manually holds the button 31 depressed as illustrated in FIG. 5, the extension member can easily be telescoped back and forth in the supporting tube and retracted to a completely closed position where the handle 13 fits neatly within the channel structure as described heretofore.

Figure 6:
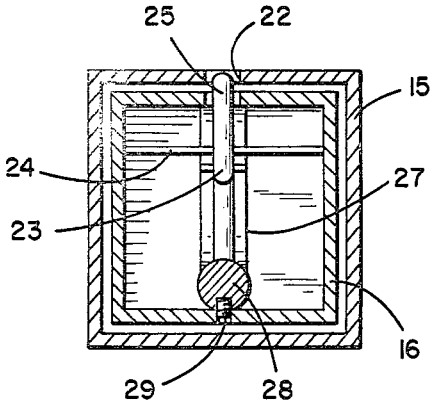
FIG. 6 is a cross section taken in the direction of the arrows 6—6 of FIG. 4.

Referring to FIG. 6, the cross section illustrates more clearly the arrangement of the guide pin 29 operating in the small slot for the rod member 28. In addition, it will be noted that the preferred cross sections for the supporting tube 15 and extension member 16 is square. Such square cross section will prevent relative rotation between the extension member and the supporting tube so that a user can apply torque by the gripping handle 13 to prevent tipping of the suitcase when rolling the same along in various types of maneuvers.

Figure 7:
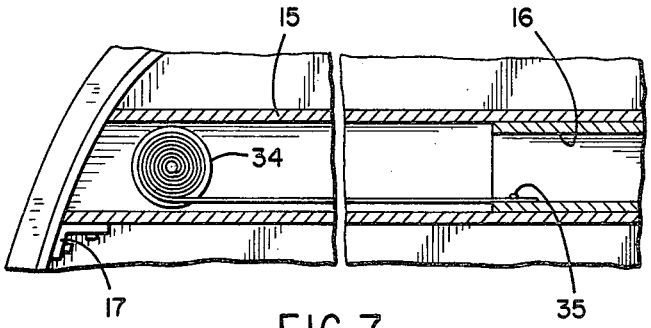
FIG. 7 is an enlarged fragmentary cross section of that portion of the structure of FIG. 3 enclosed within the circular arrow 7.

Preferably in the embodiment described with repsect to FIGS. 3 through 6, there is provided a tension spring connected to the supporting tube 15 and arranged to bias the extension member 16 to its completely retracted position. One such type of spring structure is illustrated at 34 in FIG. 7 as a negator spring, the end of the spring being connected at 35 to the innermost end of the extension member 16.

By using such a tension spring, it will be appreciated that once an operator has released the extension member by pushing of the button, the spring 34 will rapidly return the extension member automatically to its retracted position.

Figure 8:
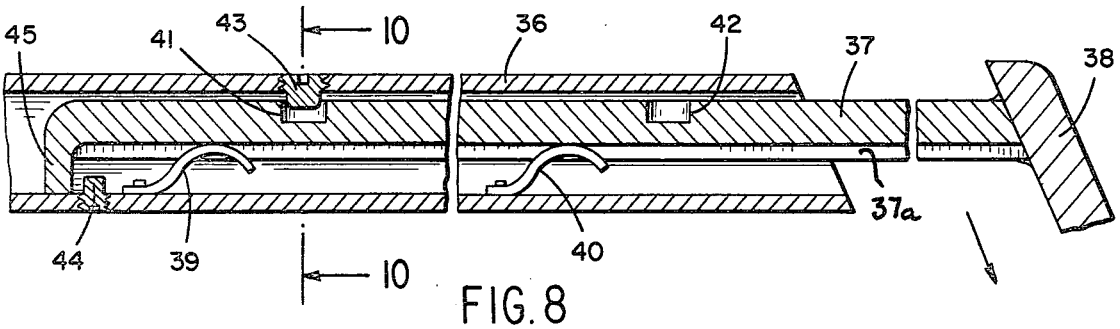
FIG. 8 is a fragmentary cross section of a second embodiment of the invention illustrating the telescoping structure in one of its locked positions.

Referring now to FIG. 8, there is shown a second embodiment of this invention wherein a square cross section supporting tube is again provided but is of a slightly modified construction from the supporting tube 15 described in the first embodiment. More particularly, in the second embodiment the supporting tube is indicated at 36 and cooperates with a modified extension member 37 telescopically received therein. The member 37 terminates at its outer end in a gripping handle 38 similar to the gripping handle 13 but not incorporating any type of button structure.

Extension member 37 in the embodiment of FIG. 8 has a cross section of rectangular solid shape, the shorter sides of the rectangle being vertical so as to leave a space beneath the extension member 37 and the floor of the supporting tube 36. Appropriate leaf springs schematically indicated at 39 and 40 urge the extension member 37 upwardly to the position illustrated in FIG. 8. These leaf springs 39 and 40 are arranged to ride in a central channel 37*a* in the extension member 37.

The cavity structures constituting part of the cooperating index means are formed in the top of the extension member 37 as indicated at 41 and 42. The laterally projecting pin in this particular embodiment, in turn, projects inwardly from the underside of the top of the supporting tube 36, as indicated at 43. In the particular relative positions illustrated, the lateral pin 43 is shown received in the cavity structure 41 to thus lock the extension member 37 in a given telescoped position which would be a second extended position in the example chosen. If the handle were retracted inwardly until the cavity 42 were opposed to the pin 43, this would constitute a first telescopically extended position.

Referring to the left portion of FIG. 8, it will be noted that there is provided a second pin 44 in the floor of the supporting tube 36, this pin functioning as a stop against a downturned end portion 45 of the extension member 37. This stop will engage the downturned portion 45 to prevent complete removal of the extension member 37 from the supporting tube 36.

Figure 9:
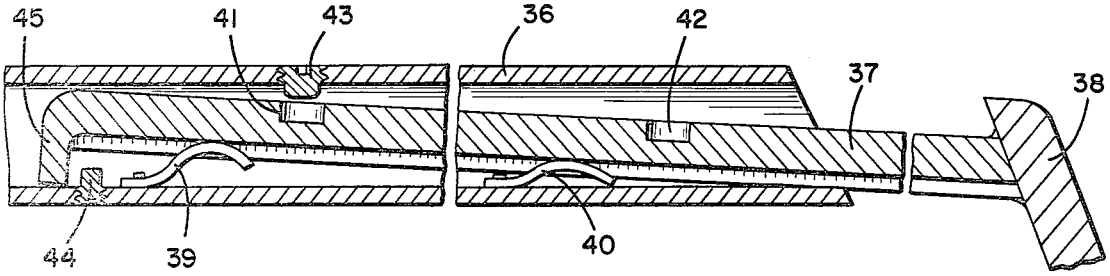
FIG. 9 is a view similar to FIG. 8 but illustrating the manner in which the telescoping structure is released.

FIG. 9 illustrates the manner in which a manual releasing means operates in the embodiment of FIG. 8. As noted, because of the spacing between the underside of the extension member 37 and the floor of the supporting tube 36, and further as a consequence of the downturned end 45, this end engaging the floor can operate as a fulcrum for manual downward depression of the extension member 37 against the bias of the leaf springs 39 and 40 as illustrated. Such downward movement will release the pin 43 from the cavity 41 and thus permit sliding movement of the extension member 37 in the supporting tube 36 to position, for example, the other cavity 42 for indexing with the pin 43. Alternatively, the member 37 can simply be completely telescoped within the supporting tube when the telescoping structure is to be completely retracted.

The embodiment of FIGS. 8 and 9 simply illustrates another type of cooperating indexing means which might be somewhat less expensive to manufacture than the push button arrangement described in FIGS. 3 to 5. On the other hand, the preferred embodiment as shown in FIGS. 3 to 5 is more advantageous than that illustrated in FIGS. 8 and 9 in that there is no possibility of any inadvertent releasing of the cooperating members unless the button is manually depressed. A further advantage in the structure of FIGS. 3 through 5 is that it is not necessary to lower the suitcase and then exert a further downward force on the extension member in order to release the same. Nevertheless, the simplicity of the structure of FIGS. 8 and 9 and the fact that there are no openings whatsoever in the supporting tube which might become entangled with clothing offers certain advantages.

Figure 10:
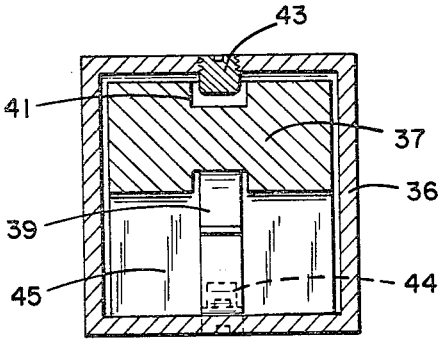
FIG. 10 is a cross section taken in the direction of the arrows 10—10 of FIG. 8.

FIG. 10 illustrates the cross sectional arrangement of the supporting tube 36 and the solid rectangular shape cross section of the extension member 37. The square and rectangular cross sections again prevent relative rotation of the extension member and supporting tube so that torque can be applied through the gripping handle to steady the suitcase against tilting tendencies when rolling along the ground.

Figure 11:
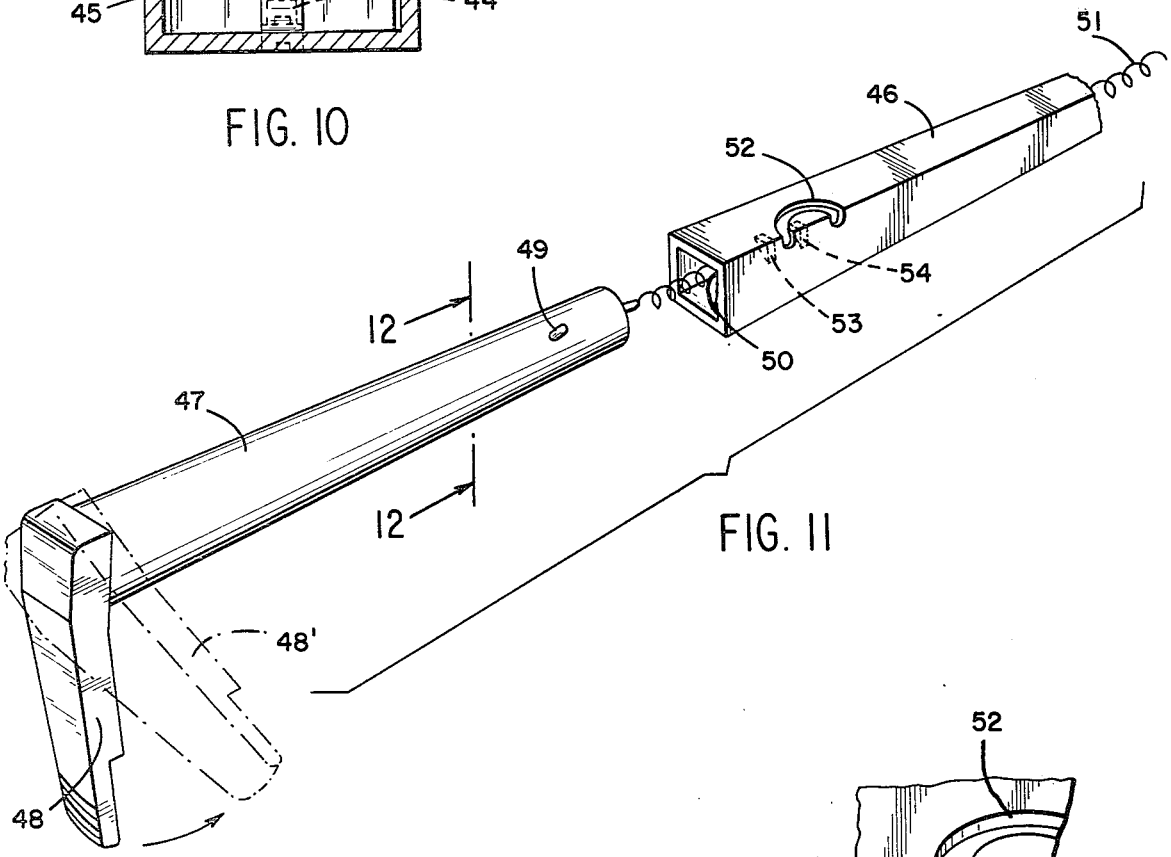
FIG. 11 is an exploded perspective view of a third embodiment of the present invention.
Figure 12:
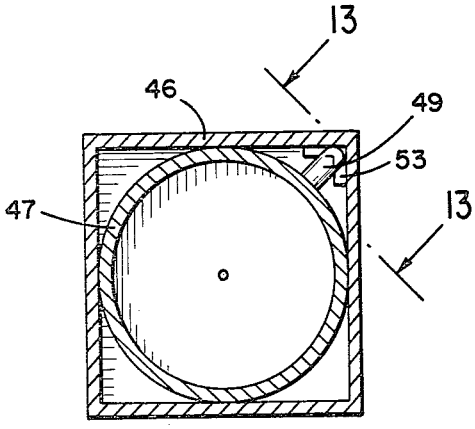
FIG. 12 is a cross section with the components of FIG. 11 in assembled relationship looking in the direction of the arrows 12—12; and, FIG. 13 is a fragmentary cross section taken in the direction of the arrows 13—13 of FIG. 12.
Figure 13:
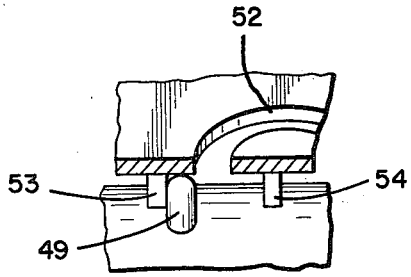

Referring now to FIGS. 11, 12 and 13 there is shown a last embodiment of this invention wherein again there is provided a supporting tube of square cross section indicated at 36 and a cooperating extension member 47 arranged to be telescopically received in the supporting tube. In the embodiment of FIG. 11, the extension member 47 has a circular cross section as shown. This member terminates in an integrally formed gripping handle 48.

The cooperating indexing means in the embodiment of FIG. 11 again incorporates a lateral pin shown at 49 and extending at 45° from the top of the extension member 47 in such a manner as to ride along a corner 50 of the supporting tube 46 when the members are telescoped together.

The foregoing can best be seen with reference to FIG. 12 wherein the pin 49 is shown riding in the corner portion of the supporting tube.

In the embodiment of FIG. 11, rather than a negator type spring secured to the inner end of the extension member as in the embodiment of FIGS. 3 through 7, a simple tension spring 51 is illustrated. It will be understood, of course, that the end of spring 51 is secured within the supporting tube 46 at its inner endmost portion and exerts a biasing force on the extension member 47 tending to retract it completely within the supporting tube.

Cooperating with the lateral pin 49 in providing the indexing means is a semi-circular shaped slot 52 formed in the top wall of the supporting tube 46. This slot communicates with a corner portion and thence runs in a semi-circular direction to terminate between first and second spaced stop members 53 and 54 formed in the corner. The space between the members 53 and 54 constitutes a receiving cavity for the pin 49.

The foregoing is better illustrated in FIG. 13 wherein the pin 49 is shown positioned between the stops 53 and 54 wherein it is essentially locked in the cavity.

In effecting this locking, the gripping handle 48 is rotated 45° to the position illustrated at 48' in FIG. 11 which moves the pin 49 and enables guiding thereof around the slot 52. Rotation of the handle 48 back to its solid line position will then move the pin 49 into the corner portion between the stops 53 and 54. When in this locked position, the roller mounted suitcase can then be guided as in the other embodiments.

Releasing of the extension member to permit retraction is accomplished by again rotating the handle 48 to and from the phantom line position illustrated in FIG. 11 to move the pin 49 back around the semi-circular slot 52 to the corner portion outside of the stops 53 and 54. Thereafter, the extension member 47 can be completed telescoped within the supporting tube 46.

The embodiment of FIGS. 11 through 13 is provided simply as a further alternative structure illustrative of appropriate cooperating indexing means to positively hold the extension member in a given telescoped position.

From all of the foregoing, it will thus be evident that the present invention has provided more positive indexing type means particularly well suited for the type of telescoping handle structure and roller mounted suitcase described.

While only one indexing position is illustrated in FIG. 11, it should be understood that a further semi-circular slot could be provided communicating with the slot 52 portion between the stops 53 and 54 to enable reinsertion of the pin 49 back into the corner and enable further outward telescoping movement to yet another semi-circular slot which would define a second extended position of the handle. The structure as actually illustrated in the embodiments of FIGS. 11 to 13 represents the simplest means of providing a locking indexing arrangement for the telescoping members involved and in its simplest form would only have the one defined locking position.

Various changes falling clearly within the scope and spirit of this invention will occur to those skilled in the art. The invention accordingly is not to be thought of as limited to the exact structure set forth merely for illustrative purposes.

I claim:

1. A pull handle for a roller mounted suitcase, including, in combination:

(a) an elongated supporting tube of square cross-section secured to said suitcase;

(b) an extension member of square cross-section having a gripping handle on one end and having its other end telescopically slidable into and out of one end of said supporting tube the square cross-section of the supporting and extension member preventing relative rotation therebetween;

(c) cooperating indexing means on said supporting tube and member for holding said member in a given extended telescoped position relative to said supporting tube so that said member is at a sufficient distance from the suitcase for convenient gripping by a user for guiding said roller mounted suitcase along the ground, said cooperating indexing means including a lever element pivotally mounted inside the hollow extension member having one end projecting through an opening in said member towards the surrounding side wall of said supporting tube, a cavity structure in said supporting tube in a position to receive said pin when said extension member is telescopically extended to said given extended telescoped position, and a spring means in said extension member biasing said lever in a manner to urge said pin laterally outwardly;

(d) manual release means operable by a person gripping said handle comprising a slide rod extending from said gripping handle within said extension member to said lever such that manual pushing of said rod end at said gripping handle causes the other end of the slide rod to rock said lever in a direction retracting said pin from said cavity structure in said supporting tube, thereby releasing said extension member and permitting said member to be fully retracted into said supporting tube when not in use.

2. A pull handle according to claim 1, including tension spring means mounted to said supporting tube and connected to the inwardly extending end of said extension member to bias said member into completely retracted position in said supporting tube.

3. A pull handle according to claim 1, in which said suitcase is generally rectangularly shaped when viewed from the side with rollers at one lower corner of said rectangular shape and said supporting tube disposed along the top of the rectangular shape with said one end receiving said member positioned at the upper corner of said rectangular shape diagonally opposite said one lower corner.

4. A pull handle according to claim 1, in which there is provided an additional cavity structure for receiving said pin when said extension member is telescoped to a second given position wherein the handle is spaced at a greater distance from said suitcase for convenient gripping by a taller-than-average person.

* * * * *